United States Patent [19]

Antonini et al.

[11] Patent Number: 4,737,158

[45] Date of Patent: Apr. 12, 1988

[54] SELF-LUBRICATING COAL AND HYDROCARBON FRACTION BASED FUEL COMPOSITION

[75] Inventors: Gérard Antonini, Paris; Olivier François, Compiegne; Christian Bernasconi, Charly par Vernaison; Dominique Bouchez, Oullins; Alain Faure, Saint Chamond, all of France

[73] Assignee: Elf France, Paris, France

[21] Appl. No.: 787,431

[22] Filed: Oct. 15, 1985

[30] Foreign Application Priority Data

Oct. 17, 1984 [FR] France ..... 84 15925

[51] Int. Cl.[4] ..... C10L 1/32

[52] U.S. Cl. ..... 44/51; 44/72; 44/76; 44/77

[58] Field of Search ..... 44/51, 72, 76, 77; 252/351

[56] References Cited

U.S. PATENT DOCUMENTS

| | | | |
|---|---|---|---|
| 4,101,293 | 7/1978 | Krause et al. | 44/51 |
| 4,358,293 | 11/1982 | Mark | 44/51 |
| 4,392,865 | 7/1983 | Grosse et al. | 44/51 |
| 4,511,364 | 4/1985 | Mitsumori | 44/51 |
| 4,536,187 | 8/1985 | Hansen et al. | 44/51 |

FOREIGN PATENT DOCUMENTS

| | | | |
|---|---|---|---|
| 1152785 | 11/1980 | Japan | 44/51 |

*Primary Examiner*—William R. Dixon, Jr.
*Assistant Examiner*—Margaret B. Medley
*Attorney, Agent, or Firm*—Burgess, Ryan & Wayne

[57] ABSTRACT

A self-lubricating fuel composition is provided formed from powdered coal, a hydrocarbon fraction, water, a surfactant and a strong electrolyte. This composition develops a lubricating layer between the mechanical parts in relative movement with respect to the fluid and the fluid. Such self lubrication causes a reduction of the friction and consequently of the pressure losses during transport in ducts.

15 Claims, No Drawings

SELF-LUBRICATING COAL AND HYDROCARBON FRACTION BASED FUEL COMPOSITION

BACKGROUND OF THE INVENTION

1. Field of the Invention

The invention relates to a self-lubricating fuel composition having a powdered coal and hydrocarbon fraction basis.

The world coal reserves greatly exceed the reserves of all the other fossile fuels put together, including even the oil shales and sands. So attention is turned towards an increased use of these reserves.

The use of coal as a fuel raises transport and even combustion problems. The ideal would be to have coal available in the form of a pumpable fluid, having storage and transport and combustion characteristics similar to those of heavy fuel oil.

2. Description of the Prior Art

A certain amount of work has been done for providing a simple solution, in so far as its principle is concerned: it is a question of dispersing powdered coal in a hydrocarbon fraction, such for example as heavy fuel oils.

However the use of simple mixtures of powdered coal and heavy oil raises numerous problems, such as the sedimentation of the coal during storage and difficult pumping due to the high viscosity of the concentrated suspension.

The use of numerous additives has been suggested for stabilizing the coal-oil suspensions. Thus, a series of Japanese patents, Nos. 7953106, 7953107, 7953108 of 1977 and the U.S. Pat. No. 4,130,401 of 1978 describes the use of polythylene glycol or polypropylene glycol or copolymers thereof. The U.S. Pat. No. 4,162,143 of 1978 relates to the use of alkylaryl sulfonates or quaternary ammoniums.

In numerous cases, the addition of a small amount of water is favorable to the stabilization of these suspensions. The stabilizing effect is however accompanied by an increase of the viscosity of the oil-coal mixtures and consequently an increase of the pressure losses during pumping.

SUMMARY OF THE INVENTION

The present invention aims at overcoming these disadvantages and providing a powdered coal and hydrocarbon fraction based suspension which remains homogeneous during storage while being readily pumpable.

The pesent invention provides a composition which self-lubricates the duct wall during transport of these mixtures in ducts.

The fuel composition of the invention is formed from powdered coal, a hydrocarbon fraction, water, a surfactant and at least one strong electrolyte.

It comprises by weight 30 to 60% and preferably 35 to 55% of coal, 5 to 25% and preferably 10 to 20% of water, 0.1 to 1% and preferably from 0.2 to 0.6% of surfactant and from 0.01 to 1% and preferably 0.1 to 0.5% of a strong electrolyte, the complement being formed of a hydrocarbon fraction.

The hydrocarbon fraction is never less than 30% of the fuel composition.

The compositions of the invention have, for the same coal concentration, an intrinsic viscosity or consistency at rest higher than that of the coal, hydrocarbon fraction, water and surfactant mixtures.

This thickening effect has favorable consequences during the storage phase of the mixture. It delays or prevents sedimentation of the coal particles.

On the other hand, if the dynamic viscosity is measured as a function of the shearing rate, a sudden drop is noted in the dynamic viscosity with an increase of the shear.

In the case of a mixture of conventional formulation, abundantly described in the literature, formed from powdered coal, a hydrocarbon fraction, water and a surfactant, the shearing stress increases rapidly with an increase in the shear.

This result was obtained from measurements made with a rotary viscosimeter of the COUETTE type equipped with two coaxial cylinders, an inner rotary cylinder, and an outer fixed cylinder, the mixture whose dynamic viscosity it is desired to measure being in the clearance therebetween and so subjected to a shearing stress. As the speed of rotation of the mobile cylinder increases, the shear rate gradient of the fluid whose viscosity is to be measured increases and the torque required for maintaining the rotational speed at the desired value increases with the shear rate gradient. This torque depends on the shearing stress.

The formulations of the invention escape this rule. In fact, in the case of measurements made with a COUETTE type apparatus, as soon as a certain value of the shear rate gradient (always very small) is reached, the increase of the shear rate gradient is accompanied by a sudden drop in the shearing stress. In other words, the cylinder rotates more and more rapidly, while consuming relatively less and less power. These apparently paradoxical results are explained by the development, during shearing, of a lubricating layer between the mechanical parts moving with respect to the fluid and the fluid, which causes a reduction of the friction between these parts and the fluid. These mechanical parts may be the walls of the cylinders of the viscosimeter but also the walls of smooth ducts through which the fluid flows. The liquid forming the lubricating layer is exuded by the composition of the invention: it is a question of a self-lubricating mechanism. This mechanism only appears in the case of the compositions claimed in this invention.

After analysis, the nature of this lubricating layer has proved to be essentially water containing a very small amount of powdered coal and a high proportion of the electrolyte present in the composition of the invention.

Physically, the thickness of this lubricating layer is extremely small (a few tens of microns, at most).

The lubricating layer considerably reduces the value of the pressure losses in the ducts and so the pumping power can be reduced in the same proportions.

The lubricating layer develops very rapidly, in a few fractions of a second after the beginning of shearing. This is industrially very advantageous for, in fact, an industrial installation comprises numerous valves, bends etc. and each of these features destroys the previously formed lubricating layer, this aqueous layer being redissolved in the whole of the mixture.

It is therefore absolutely necessary for this layer to be rapidly reformed.

The surfactant used must be capable of dispersing the water in the heavy fuel by reducing the interface tension between the two liquids. The surfactants may be of ionic or non ionic nature. The non ionic surfactants such as those containing polyethylene glycol or polypropylene glycol patterns or a combination of these patterns are particularly suitable. Among these surfactants may be mentioned alcohols, phenols, alkylphenols, amines, diamines polyethoxylated, polypropoxylated, polyethoxylated-polypropoxylated phosphates as well as polyethylene glycols, polypropylene glycols, polyalkylene glycols and generally molecules comprising in their formula one or more polyalkoxylated patterns.

The surfactant is used in a weight concentration from 0.1 to 1% and preferably from 0.2 to 0.6%.

All the strong electrolytes, which have a high dissociation coefficient in water, are suitable for the process of the invention. Among these electrolytes may be mentioned the strong bases, such as NaOH, KOH, $NH_4OH$, $Mg(OH)_2$, $Ca(OH)_2$ or the salts of organic bases such as the halides or sulfates of sodium, potassium, calcium or magnesium or mixtures thereof, this list not being limitative.

The electrolytes are used in a weight concentration between 0.01 and 1% and preferably between 0.1 and 0.5%.

The powdered coal is generally obtained by crushing and pulverizing. By crushing, coal particles are obtained whose diameters are less than about 2 mm. This crushed coal is fed into a pulverizer. In general ball or centrifugal pulverizers are used but any other type of pulverizer may also be suitable. The size of the coal particles obtained after pulverizing corresponds to the so-called industrial grain size.

The size of the particles is between 1 and 200 μm and the size of 80% of the particles is less than 80 μm. The particles greater than 200 μm are unstable and form a deposit rapidly when the mixture is kept at 60° C. the usual storage temperature for these mixtures. The particles of a size less than 1 μm are colloidal and confer on the mixture too high a viscosity.

As hydrocarbon fraction direct distillation or viscoreduction heavy oils are generally used or oil residues.

The composition of the invention is obtained by mixing the hydrocarbon fraction held at 80° C. with the powdered coal and the water containing the surfactant and the electrolyte.

The order of introducing the constituents is not important. It is also possible to form mixtures by a continuous process.

The mixture is formed using agitation systems which are suitable for viscous fluids (such as blade, anchor or helical ribbon stirrers or in line mixers).

EXAMPLES

Two types of coal were studied. One from the coalfields of the Lorraine Basin, FREYMING, the other from the BLANZY coalfield. Table 1 gives the physicochemical characteristics of the coals.

The hydrocarbon fraction used is a heavy fuel oil from visco-reduction residues. Its characteristics are given in table 2.

The intrinsic viscosity is measured through the stirring power. In fact, this power is directly linked to the intrinsic viscosity of a stirred product, the increase of intrinsic viscosity causing an increase in the stirring power.

APPARATUS FOR MEASURING THE INTRINSIC VISCOSITY

The experimental equipment comprises the following apparatus:

- a double-walled cylindrical glass container, with hemispherical bottom, of a capacity of 1.3 liters. The space defined by the double wall allows the flow of water at a high rate (1200 liters/hours) coming from a thermostatically controlled bath. The geometrical characteristics of the glass container are the following:
  Diameter: 100 mm
  Height: 185 mm
  Radius of the hemisphere: 50 mm
- a stirring assembly with two helical ribbons. The shaft is a metal rod 10 mm in diameter. The height of the assembly is 100 mm: its width at the endmost edges of the ribbons is 92 mm. Each of the two ribbons has a width of 8 mm; the pitch of the helical ribbons is 100 mm,
- an electric motor servo-controlled to a rotational speed of 60 to 1000 rpm,
- a wattmeter.

Principle of the measurement:

The unknown mixture is poured into the glass container and heated to the test temperature (80° C.). Rotation of the stirrer assembly is provided by the electric motor. The power required for such stirring is directly proportional to the intrinsic viscosity of the mixture. The stirring induces sufficient "turbulence" so that the possible lubricating phenomena cannot develop on the parts moving relative to the mixture (the stirrer assembly essentially). The stirring power does not therefore undergo the lubricating effects and it gives access to the consistency or intrinsic viscosity of the mixture.

The wattmeter measures the electric power consumed by the motor and previous calibration provides conversion of the electric power into the mechanical power effectively required for maintaining the stirring.

The mechanical stirring powers measured are shown in table 3. They reflect the intrinsic viscosity of these mixtures.

It can be seen in this table that a greater power is required for the formulations of the invention, which illustrates their greater consistency or intrinsic viscosity.

FLOW IN SMOOTH CYLINDRICAL DUCTS WITH CONSTANT SECTION

Experimental device:

The formulations of the invention were subjected to pressure loss measurements as a function of their flowrate through the ducts. The pumping installation used comprises schematically:

- a MOINEAU type pump
- a stirred reservoir
- a piping network of cylindrical ducts in series, of different diameters.

The pressure losses are measured on horizontal tubes of calibrated diameter by means of pressure sensors. The difference between two sensors spaced apart by a meter along a duct defines the pressure loss per unit of length.

The corresponding flowrate is measured by using standard measures.

The pressure losses in bars per meter are shown in detail in table 4.

As can be seen in this table, the formulations of the invention lower the pressure losses in the ducts by a factor of 100 with respect to the formulations met with in existing literature.

TABLE 1

PHYSICOCHEMICAL ANALYSIS OF THE COALS

| TYPES OF COAL | C % | H % | O % | N % | S % | Cl % | Volatile matter % crude | Volatile matter % pure | Ash rate % | PCS J/kg | PCI J/kg | Hardgrove's index | Swelling index |
|---|---|---|---|---|---|---|---|---|---|---|---|---|---|
| LAVOIR DE FREYMING MERLEBACH coalfields of the Lorraine Basin | 78.4 | 5.03 | 8.82 | 1.03 | 0.88 | 0.25 | 36.1 | 38.45 | 6.1 | 32015 $10^3$ | 30843 $10^3$ | 48.5 | 3.3 |
| BLANZY coalfield DARCY pit | 83.7 | 3.6 | 5.62 | 1.28 | 0.62 | 0.06 | 11.6 | 12.65 | 9.2 | 7904 | 7708 | 51.5 | 0 |

TABLE 2

CHARACTERISTICS OF THE HEAVY FUEL OIL

| | |
|---|---|
| Density (20° C.) = | 1.029 |
| PCI = | 39 234 $10^3$ J/kg |
| Kinematic viscosity = | 32.2 cSt (100° C.) |
| | Weight % |
| Carbon | 84.54 |
| Hydrogen | 10.65 |
| Sulphur | 3.97 |
| Ash | 0.1 |
| Asphaltenes | 6.4 |
| Conradson | 15.9 |

TABLE 3

MECHANICAL STIRRING POWER AT 80° C.

| COMPOSITION STUDIED WEIGHT % | | MECHANICAL STIRRING POWER AT 100 RPM |
|---|---|---|
| Coal | 50 | 2.5 WATTS |
| Heavy oil | 44.5 | |
| Water | 5 | |
| Surfactant (NP6) | 0.5 | |
| Coal | 50 | 3.1 WATTS |
| Heavy oil | 34.17 | |
| Water | 15 | |
| Surfactant | 0.5 | |
| NaOH | 0.33 | |

NP6 = nonylphenolhexaethoxylated

TABLE 4

PRESSURE LOSS IN BARS PER METER

| Composition studied weight % | | Flowrate $cm^3$/sec 25 | 35 | 45 | 55 |
|---|---|---|---|---|---|
| Coal | 50 | 1.7 | 2.2 | 2.6 | 3.1 |
| Heavy oil | 44.5 | | | | |
| Water | 5 | | | | |
| Surfactant | 0.5 | | | | |
| Coal | 50 | 0.01 | 0.012 | 0.014 | 0.015 |
| Heavy oil | 34.17 | | | | |
| Water | 15 | | | | |
| Surfactant (NP6) | 0.5 | | | | |
| NaOH | 0.33 | | | | |
| Coal | 50 | 1.5 | 2 | 2.4 | 2.8 |
| Heavy oil | 50 | | | | |

NP6 = nonlyphenolhexaethoxylated
tube of inner diameter 12 mm
pumping temperature 80° C.

What is claimed is:

1. A self-lubricating fuel composition comprising powdered coal, at least 30% by weight of a hydrocarbon fraction, water, surfactant and containing from 0.01 to 1% by weight of at least one strong electrolyte hydroxide base, said composition forming under shear conditions a lubricating layer consisting essentially of water, a high proportion of said electrolyte hydroxide base present in said composition and a very small amount of powdered coal.

2. A composition as claimed in claim 1, wherein said base is chosen from sodium, potassium, ammonium, magnesium, calcium hydroxides bases.

3. A composition as claimed in claim 1 wherein said powdered coal is present in a weight concentration of from 30 to 60%.

4. A composition as claimed in claim 1, wherein the water is present in a weight concentration of from 5 to 25%.

5. A composition as claimed in claim 1, wherein the surfactant is present in a weight concentration of from 0.01 to 1%.

6. A composition as claimed in one of claim 1 wherein said surfactant is a non ionic surfactant.

7. A composition as claimed in claim 6, wherein said non ionic surfactant comprises a polyalkoxylated moiety in its structure.

8. A composition as claimed in claim 7, wherein said polyalkoxylated surfactant is chosen from alcohols, phenols, alkylphenols, amines, diamines and polyethoxylated, polypropoxylated or polyethoxylated-polypropoxylated phosphates.

9. A composition as claimed in one of claim 1 wherein said hydrocarbon fraction is a heavy fuel.

10. A self lubricating composition of claim 1 containing from about 0.1 to 0.5% by weight of strong electrolyte hydroxide base.

11. A composition of claim 3, containing from about 35 to 55% by weight of powdered coal.

12. A composition of claim 1, containing from about 10 to 20% by weight of water.

13. A composition of claim 1, containing from about 0.2 to 0.6% by weight of surfactant.

14. A self lubricating fuel composition of claim 1, comprising by weight;

| | |
|---|---|
| 30–60% | powdered coal |
| 5–25% | water |
| 0.01–1.0% | surfactant |
| 0.01–1.0% | strong electrolyte hydroxide base |
| at least 30% | hydrocarbon fraction. |

15. A self lubricating fuel composition of claim 14, comprising by weight:

| | |
|---|---|
| 35–55% | powdered coal |
| 10–20% | water |
| 0.2–0.6% | surfactant |
| 0.1–0.5% | strong electrolyte hydroxide base |
| at least 30% | hydrocarbon fraction. |

* * * * *